United States Patent [19]

Shapiro et al.

[11] Patent Number: 4,933,680

[45] Date of Patent: Jun. 12, 1990

[54] MICROSTRIP ANTENNA SYSTEM WITH MULTIPLE FREQUENCY ELEMENTS

[75] Inventors: Sanford S. Shapiro, Canoga Park; Clinton W. Pederson, South El Monte, both of Calif.

[73] Assignee: Hughes Aircraft Company, Los Angeles, Calif.

[21] Appl. No.: 250,877

[22] Filed: Sep. 29, 1988

[51] Int. Cl.[5] ..... H01Q 1/36

[52] U.S. Cl. ..... 343/700 MS; 343/853; 342/368

[58] Field of Search ..... 343/700 MS, 738, 862, 343/777, 757, 853, 876; 333/1.1, 24.2, 126, 128, 129, 132, 134; 342/368, 372, 373

[56] References Cited

U.S. PATENT DOCUMENTS

| | | | |
|---|---|---|---|
| 3,865,990 | 2/1975 | Kuenemund | 333/134 |
| 4,024,478 | 5/1977 | Wolfe | 333/24.2 |
| 4,454,514 | 6/1984 | Itoh et al. | 343/700 MS |
| 4,559,489 | 12/1985 | Vacanti et al. | 333/128 |
| 4,595,926 | 1/1986 | Kobus et al. | 343/777 |
| 4,623,894 | 11/1986 | Lee et al. | 343/700 MS |
| 4,688,259 | 8/1987 | Eldridge | 333/132 |
| 4,809,008 | 2/1989 | Gunton | 343/700 MS |

FOREIGN PATENT DOCUMENTS

| | | | |
|---|---|---|---|
| 0086202 | 6/1980 | Japan | 333/134 |

OTHER PUBLICATIONS

Mahiev, J. R., Millimeter Wavelength Passive Components, Microwave Journal, Nov. 1976.

*Primary Examiner*—Rolf Hille
*Assistant Examiner*—Doris J. Johnson
*Attorney, Agent, or Firm*—Steven M. Mitchell; Robert A. Westerlund; Wanda Denson-Low

[57] ABSTRACT

An antenna system includes an array of microstrip antenna elements wherein each of the elements includes two or more radiators. Electromagnetic signals are coupled from an input terminal of each element via one or more circulators which allow for application of an input signal to a first of the radiators followed by rerouting of respective signals to the next radiator. The radiators are turned to radiate at successively higher portions of the electromagnetic spectrum. By virtue of reflections of higher frequency radiation from a radiator tuned to a lower portion of the signal spectrum, each radiator radiates only that portion of the signal spectrum falling within the bandwidth of the radiator. By using three radiators, each antenna element is capable of radiating a signal spectrum three times as wide as are the bandwidths of a single radiator. Included within the antenna system is one or more power dividers to form one or more beams of radiation. With the use of plural power dividers, switching circuitry may be employed to select sequentially individual ones of the power dividers so as to scan a beam of radiation.

11 Claims, 4 Drawing Sheets

MICROSTRIP ANTENNA SYSTEM WITH MULTIPLE FREQUENCY ELEMENTS

BACKGROUND OF THE INVENTION

This invention relates to an array antenna constructed of microstrip elements and, more particularly, to an array antenna wherein each element is formed of a plurality of radiators tuned to radiate in different frequency bands.

Microstrip antenna systems are employed advantageously in spacecraft and other environments requiring a compact antenna structure. An array antenna is constructed readily from a board which is formed of dielectric material and is clad with metallic sheets on opposed surfaces of the board. An array of pad-shaped antenna elements interconnected by electrically conductive metallic strips is etched readily from a metallic sheet on one side of the board. Photolithographic techniques may be employed in the etching to facilitate manufacture and to provide for high precision in the formation of the antenna elements and the interconnecting conductors.

The electrical characteristics of microstrip antenna element are of particular interest in the design of an individual antenna element, as well as in the design of an array of the antenna elements. The thickness of the original board determines the distance between an antenna element on one surface of the board and a ground plane provided by the metallic sheet on the opposite surface of the board. The electrical characteristics are influenced by the distance between element and ground plane. In terms of the electromagnetic operation of a pad-shaped antenna element, the physical structure of the element spaced apart from the ground plane may be likened, for purposes of analysis and understanding of the operation, to an open walled cavity which resonates at specific electromagnetic modes, and with a relatively high value of Q, the ratio of energy stored to energy dissipated per cycle of electromagnetic signal.

As an example in the effect of the distance between element and ground plane upon the electrical characteristics, it is noted that a decreasing of the distance increases the Q of the open-walled cavity, suppresses the development of surface waves which can propagate from element to element along the surface of the array, suppresses blind angles in the viewing of subject matter during a scanning of a beam radiated by the array, and reduces bandwidth to signals which are to be transmitted or received by the array of antenna elements. This dependency of electrical characteristics upon the distance between element and ground plane has necessitated a compromise in the choice of the electrical characteristics for a microstrip array antenna. For example, if the distance has been decreased to avoid surface waves and scan blindness, the resultant antenna may have too narrow a bandwidth to be useful for the performance of a desired mission. The lack of sufficient bandwidth creates a problem in two areas. One area relates to the transmission of a broadband signal, this being a signal having a bandwidth larger than that provided by the foregoing antenna element. The second area of concern relates to the generation of a fan beam which is to be scanned by variation of a frequency of the electromagnetic radiation. By way of example in the generation of such fan beams, one common configuration of an antenna comprises a set of antenna elements, or subarrays which are interconnected by fixed delays.

A variation in the frequency of electromagnetic radiation introduces a variation in phase shift among signals outputted by successive ones of the antenna elements or subarrays. A successful scanning of such a fan beam presupposes that each of the antenna elements or subarrays has a sufficiently wide bandwidth to accommodate the shift in frequency. However, in the case of presently available microstrip array antennas, the narrow bandwidth unduly limits the transmission of broadband signals, and the use of a frequency-scanning fan beam.

SUMMARY OF THE INVENTION

The foregoing problem is overcome, and other advantages are provided by a microstrip antenna system wherein, in accordance with the invention, each of the antenna elements is formed as an array of radiators with each radiator of an antenna element being configured to resonate at a frequency different from other radiators of the antenna element. For example, a set of three or four radiators may be employed in the construction of a single antenna element. Each radiator has the form of a square pad, it being understood that the pad may have some other form such as a rectangular or circular shape for providing a specific radiation characteristic. In particular, it is noted that a square-shaped pad with a slot therein extending diagonally is useful in the generation of a circularly polarized radiation.

In accordance with a further feature of the invention, each of the radiators of a single element are configured to transmit and receive radiation in separate frequency bands wherein frequency bands of a succession of the radiators are disposed in the spectrum as a succession of contiguous transmission/reception bands. In the ensuing discussion, the invention will be taught with reference to the transmission of radiation, it being understood that the antenna operates in reciprocal fashion for receiving incoming electromagnetic signals. By way of example in the construction of a set of the radiators in a single antenna element, the radiator nearest the feed has a larger size for transmission at a low-frequency portion of the transmission band, a second of the radiators has a smaller size for transmission of signals at mid-band frequencies, and a third of the radiators has a still smaller size for transmission of a high-frequency portion of the band.

The radiators are connected by ferrite circulators. Operation of the circulators with the radiators may be demonstrated with reference to the foregoing example of three radiators tuned to different frequencies. The lowest frequency radiator is connected via a first circulator to the feed. The second radiator is connected via a second circulator to an output terminal of the first circulator. The third radiator is connected to an output terminal of the second circulator. By way of example, electromagnetic radiation including a low-band signal, a mid-band signal, and a high-band signal is fed to a first port of the first circulator. These signals are outputted by a second port of the first circulator to the first radiator. The low-band signal radiates from the radiator and the mid-band and the high-band signals are reflected back to the first circulator. These signals then exit a third port of the first circulator to enter a first port of the second circulator. The second circulator outputs these signals to the second radiator which radiates the mid-band signal while reflecting the high-band signal back to the second circulator. The second circulator then outputs the high-band signal from a third port to the third radiator. In this way, each of the radiators of an antenna element receives and transmits a specific portion of the overall signal band enabling the antenna element to radiate a signal having a bandwidth equal to two, three or four times the bandwidth of a single radiator, depending on the number of radiators or circulators employed. Embodiments of the invention will be described to demonstrate a plural-radiator antenna element for a phased array antenna transmitting a broad bandwidth signal without use of a reflect, and for a frequency-scanning fan beam reflector antenna system useful in the communication of signals from a satellite to stationary or mobile receivers, or transceivers, at various locations on the earths surface.

In one embodiment of the invention, a complementary microstrip antenna system, which may be configured as a planar array, illuminates a reflector to provide frequency scanned beams. This antenna system offers significantly reduced complexity, smaller size, lower weight and reduced RF losses. This antenna system of this embodiment of the invention can be operated without need of a beam forming network, a confocal reflector system, a Butler matrix or a large bulky direct radiating array.

BRIEF DESCRIPTION OF THE DRAWING

The aforementioned aspects and other features of the invention are explained in the following description, taken in connection with the accompanying drawing wherein.

DETAILED DESCRIPTION

Figure 1:
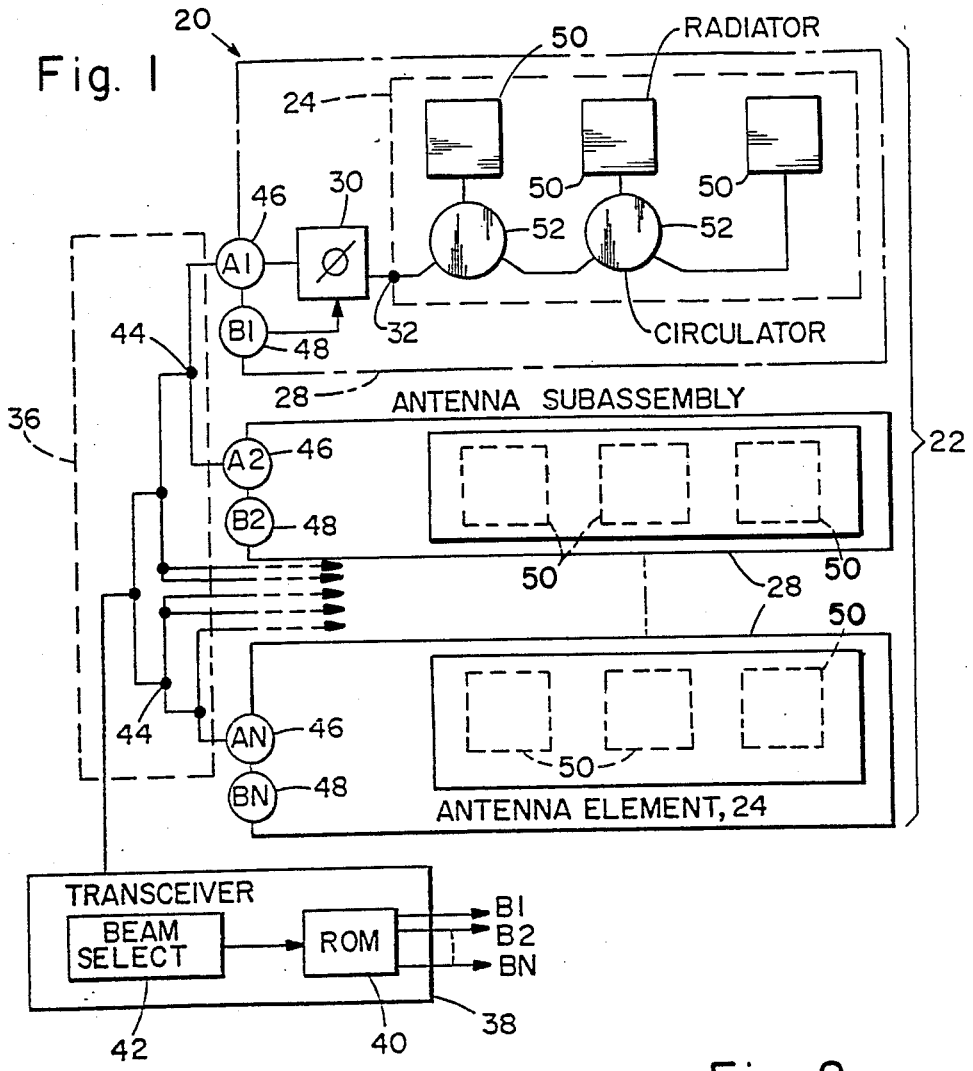
FIG. 1 is a diagrammatic view of an antenna system including a phased array antenna constructed of microstrip antenna elements wherein each element is a plural-radiator element in accordance with the invention, the antenna being employed for the transmission of a broadband signal.
Figure 2:
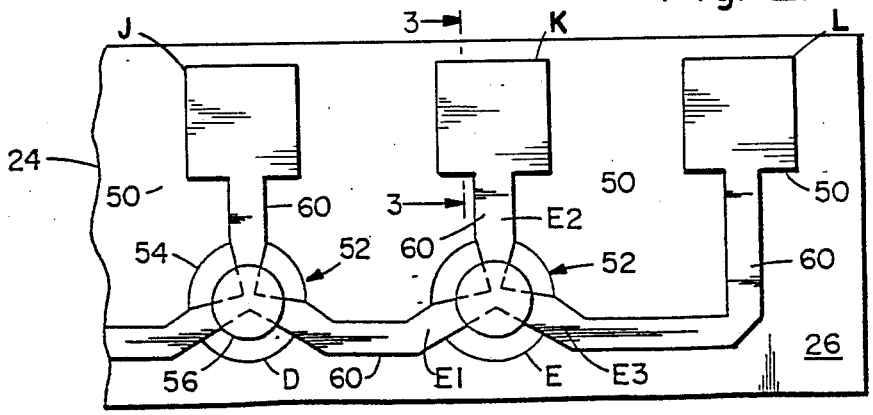
FIG. 2 is an enlarged simplified plan view of an antenna element of FIG. 1.
Figure 3:
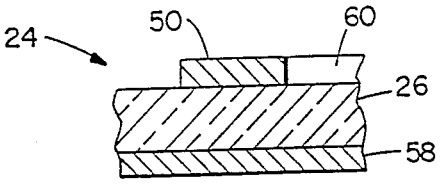
FIG. 3 is a fragmentary sectional view of a radiator taken along the line 3—3 in FIG. 2.

FIGS. 1-3 show an antenna system 20 constructed in accordance with the invention. The system 20 includes an array antenna 22 which comprises an array of antenna elements 24 each of which is constructed of microstrip on a dielectric slab 26 (FIG. 3). Each antenna element 24 is formed as a part of an antenna subassembly 28 which also includes a phase shifter 30 connected to an input terminal 32 of the element 24. Also included within the system 20 is a power divider 36 connected to a transceiver 38, and a read-only memory 40 which stores phase shift commands for the phase shifters 30 for development of a beam of radiation transmitted by the antenna 22. As a convenience in describing the invention, the transceiver 38 and the antenna 22 will be described in terms of generating and transmitting a beam of electromagnetic radiation, it being understood that the antenna system 20 is reciprocal in operation so that the description applies equally well to a reception of electromagnetic signals.

The transceiver 38 includes circuitry (not shown) for transmitting and receiving electromagnetic signals. Also included in the transceiver 38 are the memory 40 and a beam selector 42 which addresses the memory 40 to select the set of phase shift commands for generating a beam in a specific direction. The beam can be redirected by selecting a different set of phase shifts for the various phase shifters 30. The selector 42 may be a digital encoder which is manually operated to select a beam direction, or may be an address generator of an automatic beam scanning system. The power divider 36 comprises a set of power splitters 44 which are connected in the arrangement of a corporate feed structure, each of the splitters 44 dividing incident transmitted power equally among the two branches of the splitter. The power divider 36 couples power from the transceiver 38 in equal amounts, via input terminals 46, to the phase shifters 30 of the respective subassemblies 28. Command signals from the memory 40 are coupled via input terminals 48 to the phase shifters 30 of the respective subassemblies 28. Individual ones of the terminals 46 are identified by legends A1, A2, . . . AN; individual ones of the terminals 48 are identified by legends B1, B2, . . . BN.

Each of the antenna elements 24 comprises radiators 50, three such radiators being shown by way of example, it being understood that, if desired, only two of the radiators 50 might be employed or, alternatively, four or more radiators 50 might be employed in the construction of an antenna element 24. For ease of reference, the three radiators 50 are identified further in FIG. 2 by the legends J, K and L. The three radiators 50 are interconnected by ferrite circulators 52 which, for convenience, are identified further in FIG. 2 by the legends D and E. The number of circulators 52 required to interconnect the radiators 50 is one less than the number of radiators. Thus, in the case of the three radiators 50, two of the circulators 52 are employed. Only one circulator 52 is required in the event that the antenna element has only two radiators. In the case of an antenna element having four of the radiators, then a total of three of the circulators 52 are required for interconnection of the radiators.

With reference to the construction of the antenna element 24 with radiators 50, the first circulator D interconnects the radiator J via the input terminal 32 to the phase shifter 30. The second circulator E interconnects the first circulator D, the second radiator K, and the third radiator L. Each of the circulators 52 comprises a ferrite disk 54 located between two centrally disposed magnets 56, one on either side of the dielectric slab 26

(only a top one of the magnets 56 being shown in FIG. 2). In each circulator 52, the ferrite disk 54 acts in response to a constant magnetic field provided via the two centrally disposed magnets 56 to provide for an encircling guidance of electromagnetic waves about the circulator 52 . In accordance with a well-known construction of the circulators, three ports are provided, the three ports being spaced uniformly at 120 degree angles about the disk 54 to provide for a combination of the circulating waves for the transmission of power from one port to the next port. Both of the circulators 52 operate in the same fashion, so that only the operation of the circulator E need be described. Power entering a first port E1 exits at a second port E2. Power entering port E2 exits at port E3. Power entering port E3 exits at port E1. The combination of the circulating waves provides that essentially all of the power exits from only one port with no more than a negligibly small amount of power exiting from the remaining port.

As shown in FIG. 3, the antenna element 24 includes a ground plane 58 which is formed as a sheet of metal, such as copper or gold, disposed on a back surface of the slab 26. The radiator 50 is formed as a metallic pad, which may be of the same metal as the ground plane 58, disposed on a front surface of the slab 26 opposite the ground plane 58. The configuration of the pad of the radiator 50 being spaced apart from the plane 58 with dielectric material of the slab 26 therebetween is recognized as being the configuration of a capacitor, and also the configuration of an open-walled cavity resonator. It is this mechanical configuration which gives the electrical characteristics to the radiator 50, particularly in terms of such bands of frequency of electromagnetic waves which may be radiated from a radiator 50, or reflected from the radiator 50 back into a circulator 52. Metallic strip conductors 60 interconnect the radiators 50 with the circulators 52. Sections of the conductors 60 which enter into a circulator 52 are tapered towards the center of the circulator 52, in accordance with the usual practice in the formation of the circulator ports.

Figure 4:
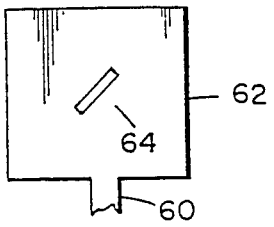
FIG. 4 shows a plan view of a radiator having an alternate configuration.

FIG. 4 shows a configuration of radiator 62 which has a square-shaped configuration, and is provided with a diagonally oriented slot 64 which provides for a circular polarization to electromagnetic waves radiated from the radiator 62. The radiator 62 is excited by way of a strip conductor 60, as is the case with the radiators 50 of FIG. 2. In the ensuing description of the operation of the invention, reference will be made to the radiators 50, it being understood that the description of the operation applies also to radiators having a different configuration such as the radiator 62.

The operation of the antenna element 24 may be explained with reference to the graphs of FIG. 5. Each of the radiators J, K, and L radiate in a specific frequency band, these bands being indicated by the legends J, K, and L in the upper graph of FIG. 5. A further trace M, shown in dashed line, is provided to demonstrate the radiation characteristic of yet a fourth radiator, if such radiator would be present as is the case for further embodiments of the invention to be described. An important characteristic of the radiators 50 is the fact that each radiator reflects back to a circulator 52 such portion of radiant energy lying in a spectral region at higher frequency than the radiation band of the radiator. The radiators of an antenna element are constructed with slightly different configurations or dimensions, or are loaded to offset their frequency characteristics. This is demonstrated in the lower graph of FIG. 5 wherein traces of the graph are similarly labeled with the legends J, K, and L to correspond to the radiators J, K, and L. The radiator J is shown to radiate electromagnetic energy at frequencies within its radiation passband, but to reflect radiant energy at frequencies above the passband. Similar comments apply to the radiators K, and L as well as to a fourth radiator, shown in phantom, for an embodiment of the invention having four radiators.

With respect to FIGS. 1 and 2, the foregoing principles of operation provide the following very useful result. A broadband signal can be transmitted by the transceiver 38 via the antenna element 24, even though the signal bandwidth is broader than the radiation band of any one of the radiators 50. Assuming, by way of example, that the signal bandwidth extends over the spectral regions J, K, and L of FIG. 5, then all of the power is incident via the input terminal 32 and via the circulator D to the radiator J. The spectral portion of the radiation band of the radiator J is radiated into space, while the spectral portions of the electromagnetic energy for the radiators K and L is reflected back from the radiator J to the circulator D. The remaining two spectral portions are then transmitted via the circulator E to the radiator K wherein the K portion is radiated, and the L portion is reflected back to the circulator E. The circulator E then outputs the L portion to the radiator L. Thereby, the three radiators J, K and L, acting in concert, are capable of radiating an electromagnetic signal having a bandwidth three times the size of a bandwidth of a single one of the radiators 50. If the antenna element 24 employed only two of the radiators 50, then the bandwidth capacity of the element 24 would be only twice that of a single radiator 50. In contrast, if the elements 24 employed four of the radiators 50, then an electromagnetic signal having a bandwidth four times that of a single radiator 50 could be transmitted, and received, by the antenna elements 24.

With respect to the generation of a beam of radiation by the array antenna 22, which antenna includes a plurality of subassemblies 28, having the aforementioned antenna elements 24 with the three radiators 50, it is noted that the phase shifter 30 in each of the subassemblies 28 introduce phase shifts among signals radiated by the radiators J, in the various subassemblies 28. Corresponding phase shifts are introduced between the corresponding radiators K, and between the corresponding radiators L of the various subassemblies 28. Thereby, the signal radiated in each of the three signal bands receives the necessary phase shifts to enable the array of antenna elements 24 to combine the signals for the generation of a beam in a desired direction relative to the array of the antenna 22. By way of example in the construction of the phase shifters 30, each of the phase shifters may be a 3-bit PIN diode phase shifter which introduces a phase shift in accordance with a digital command signal applied at a terminal 48 by the memory 40.

The physical configuration of the array antenna 22 provides that the radiators J in each of the antenna elements 24 has a spacing of approximately one-half wavelength of the radiated electromagnetic waves. Corresponding spacing is provided between the element 24 for the radiators K and the radiators L. This spacing provides for a well defined beam pattern essentially free of grating nulls and grating lobes. As a matter of convenience in the construction of an antenna element 24, the phase shifter 30 and the element 24 may be supported upon a common slab 26. If desired, a single slab 26 can be employed in the construction of the entire antenna 22 with all of the elements 24 and the phase shifters 30 being constructed on the same slab 26. Furthermore, the power divider 36, which may be fabricated of strip conductor elements, can also be placed on the same slab 26 with the antenna subassemblies 28. This provides for a single mechanical assembly for both the power divider 36 and the array antenna 22.

In the embodiment of the invention disclosed in Figs. 1–5, beam generation and steering is accomplished by an array antenna without use of a reflector. In alternative embodiments of the invention disclosed in FIGS. 6–10, a reflector is used in conjunction with an array antenna for generating and steering a beam.

Figure 5:
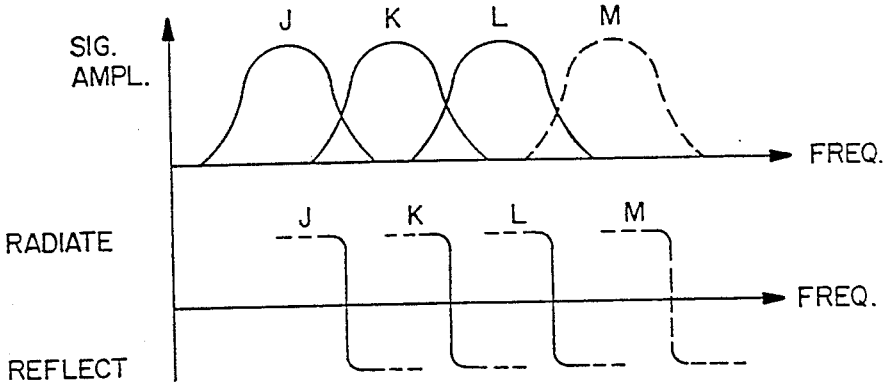
FIG. 5 is a set of graphs showing frequency responsivity of a set of radiators of FIG. 1.
Figure 6:
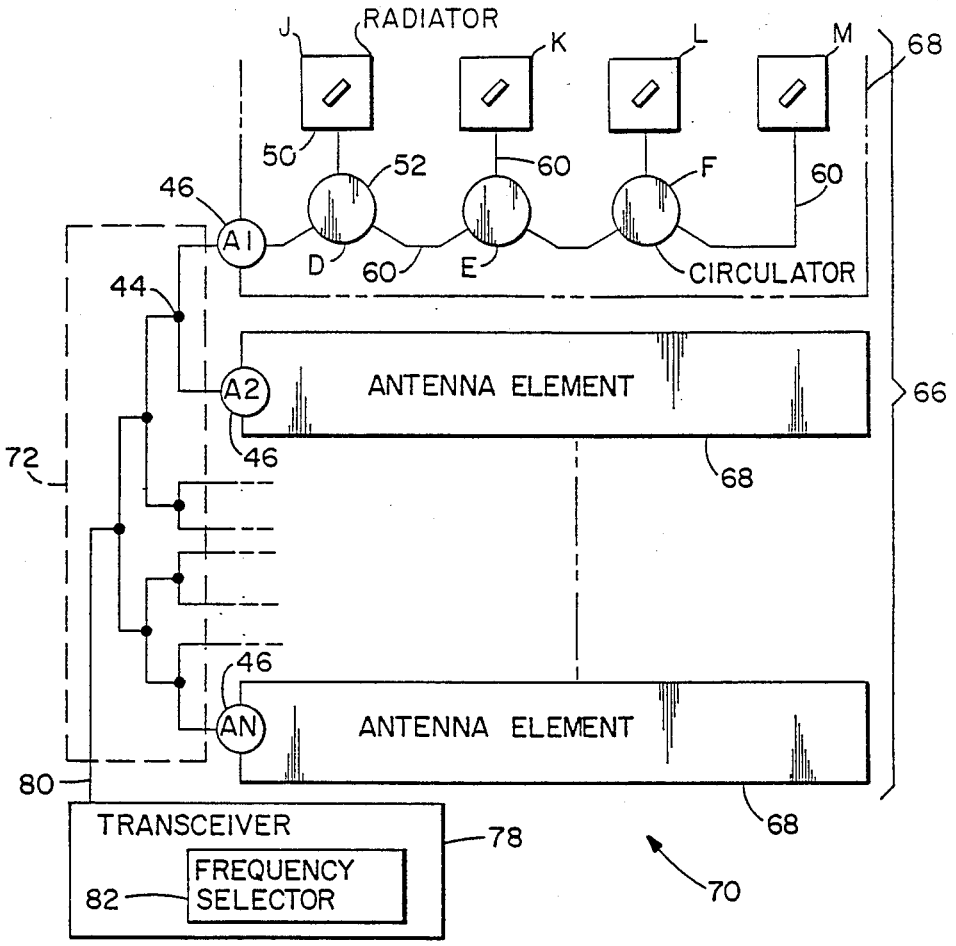
FIG. 6 shows an antenna system reflector feed employing the plural-radiator microstrip antenna elements of the invention for the generation of a frequency-scannable fan beam.

FIG. 6 shows an alternative embodiment of the invention wherein an array antenna 66 comprises a set of antenna elements 68 arranged side-by-side for forming a beam of radiation. The antenna 66 of FIG. 6 has the same general configuration as does the antenna 22 of FIG. 1, except that the phase shifters 30 of FIG. 1 have been deleted in the embodiment of FIG. 6. Also, in the embodiment of FIG. 6, each of the antenna elements 68 has a set of four radiators 50 instead of the three radiators in the embodiment of FIG. 1. Also, in the embodiment of FIG. 6, each of the elements 68 has three circulators 52 instead of the two circulators provided in the embodiment of FIG. 1. For ease of reference, the radiators 50 and elements 68 in FIG. 6 are further identified by the legends J, K, L, and M, and the circulators 52 are further identified by the legends D, E, and F. The explanation of operation disclosed above with reference to FIG. 5, applies also to the operation of an antenna element 68 of FIG. 6. The construction of the element 68 employs the same cross-sectional configuration as was disclosed with reference to FIG. 3 wherein a radiator 50 is spaced apart from a ground plane 58 by a dielectric slab 26. Interconnections between radiators 50 and the circulators 52 of FIG. 6 is provided by strip conductors 60 as was disclosed for the embodiment of FIG. 2.

The array antenna 66 is part of an antenna system 70 which includes also power divider 72 comprising a set of power splitters 44. The power divider 72 connects with each of the antenna elements 68 via their respective input terminals 46. The power splitters 44 are connected in the arrangement of a corporate feed structure, each of the splitters 44 dividing incident transmitted power with a specific ratio among the two branches of the splitter to provide the desired power split. A transceiver 78 connects to an input end 80 of the power divider 72 for applying electromagnetic signals via the power divider 72 to the antenna elements 68 for transmission into space as a beam of radiation. In contradistinction to the broadband signal transmitted by the system of FIG. 1, the system of Fig. 6 operates with a narrow band signal which can be scanned across the spectral portions J, K, L, and M of FIG. 5. For example, data may be transmitted by modulation of a data-carrying signal onto a carrier frequency at the transceiver 78, which carrier frequency may be scanned. The frequency selector 82 within the transceiver 78 allows for manual selection of the carrier frequency, or for an automatic scanning of the carrier frequency.

With reference to FIG. 5, it may be appreciated that the narrowband signal may be scanned across the composite bandwidth of the four spectral portions of the radiators J, K, L, and M. Assume, by way of example, that the radiation frequency starts at a low value, this being in the spectral portion of radiator J. Then as the radiation frequency is increased sufficiently, the radiator J reflects the signal back through the circulators D and E to radiate out from radiator K. Tuning of the radiators can be accomplished by use of a tuning structure such as a stub, (not shown) or, preferably, as is accomplished in the preferred embodiment of the invention, by constructing each of the radiators 50 in an element 68 with slightly different physical dimensions. The radiators in the embodiment of FIG. 2 are tuned to radiate at their specific frequencies in the same fashion as is employed in the construction of the embodiments of FIG. 6. The radiators J in the set of elements 68 are spaced apart by approximately one-half wavelength of the radiated electromagnetic waves, similar comments applying to the radiators K, L, and M of the set of elements 68. This spacing among the radiators provides for a well defined beam pattern.

Figure 7:
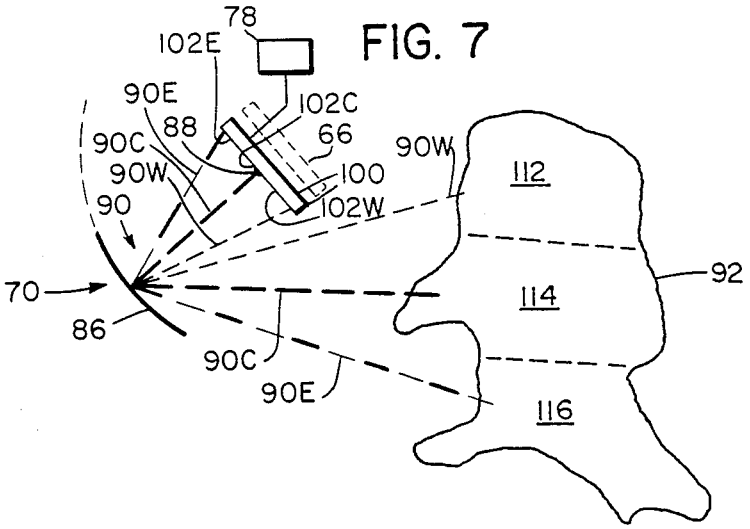
FIG. 7 is a stylized schematic view of a satellite carrying the antenna system of the invention with a reflector for scanning fan beam across various portions of the earth.

With reference to FIG. 7, the antenna system 70 may include a reflector 86 which is curved, typically with a second order curve such as a parabolic surface about a focus 88. The antenna 66, shown in phantom, may be located at the focus 88, and direct radiation towards the reflector 86 to provide a scanned beam 90. Typically, the beam 90 is a fan beam. Preferably, as will be described subsequently with reference to Fig. 10, an antenna system 100 is to be inserted at the focus 88 in place of the antenna 66, as shown in solid lines in FIG. 7. In the antenna system 100, there are three array antennas 102 of which individual ones are further identified by the legends E for east, C for central, and W for west for reasons which will become apparent in the ensuing discussion.

In the exemplary use of the invention, as disclosed in FIG. 7, the antenna system 70 is carried on board a satellite, and the reflector 86 directs a fan beam towards a portion of the earth 92, here represented as the United States of America. Scanning of the beam will be explained with reference to FIG. 10. Such use of a scanned beam from a satellite permits communication among stations located at various points on the earth's surface, which stations have suitable transmission and receiving equipment for communicating via satellite. Deployment of the invention in the satellite configuration of FIG. 7 provides various advantages which will be described hereinafter.

Figure 8:
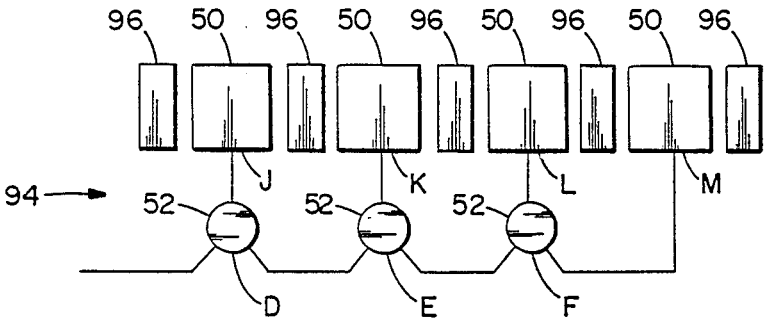
FIG. 8 shows a modified configuration of the antenna element of FIG. 6 wherein a single parasitic element is disposed between successive ones of the radiators.

FIG. 8 shows an antenna element 94 which employs a form of construction which is an alternative embodiment of the antenna element 68 of FIG. 6. In FIG. 8, the antenna element 94 comprises the same radiators 50 and circulators 52 as was disclosed with reference to Fig. 6, and further includes parasitic radiators 96 which are inserted between the radiators 50 which are actively driven by the circulators 52. The arrangement of the radiators provides for an alternating sequence of the parasistic radiators 96 and the active radiators 50. If desired, parasitic radiators 96 may be placed also at opposite ends of the radiator 50 as shown in FIG. 9.

Figure 9:
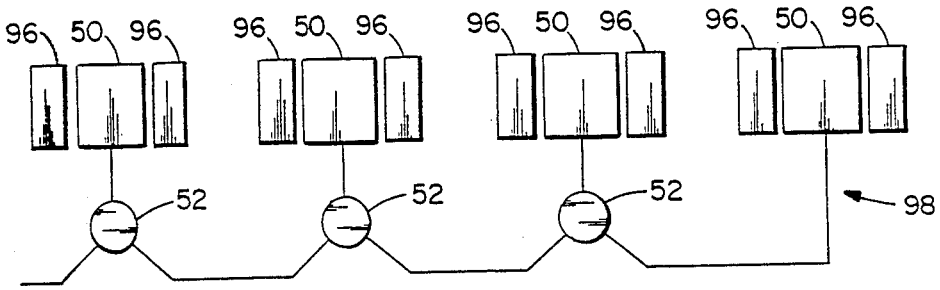
FIG. 9 is a further modification of the antenna element of FIG. 6 wherein two parasitic elements are disposed on opposite sides of each of the radiators.

FIG. 9 shows an element 98 which is yet a further embodiment of the element 68 of FIG. 6, and differs from the embodiment of FIG. 8 in that further parasitic radiators 96 are employed in the element 98 of FIG. 9. The parasitic radiators 96 in the embodiments of both FIGS. 8 and 9 are formed as metallic pads disposed on the front surface of the slab 26 in the same fashion as was disclosed in FIG. 3 for the construction of an active radiator 50. Instead of the alternating sequence of FIG. 8, in FIG. 9, each of the active radiators 50 is provided with a pair of parasitic radiators 96, there being one parasitic radiator 96 on each side of an active radiator 50. Thus, in the antenna element 98 of FIG. 9, there are twice as many parasistic radiators 96 as there are active radiators 50. The active radiators 50 are driven by signals from the circulators 52 in the same fashion as was described above for the embodiments of FIGS. 8 and 6. The parasitic radiators in the embodiments of FIGS. 8 and 9 aid in side lobe suppression of the radiation pattern of the beam as the beam is scanned across the earth's surface.

Figure 10:
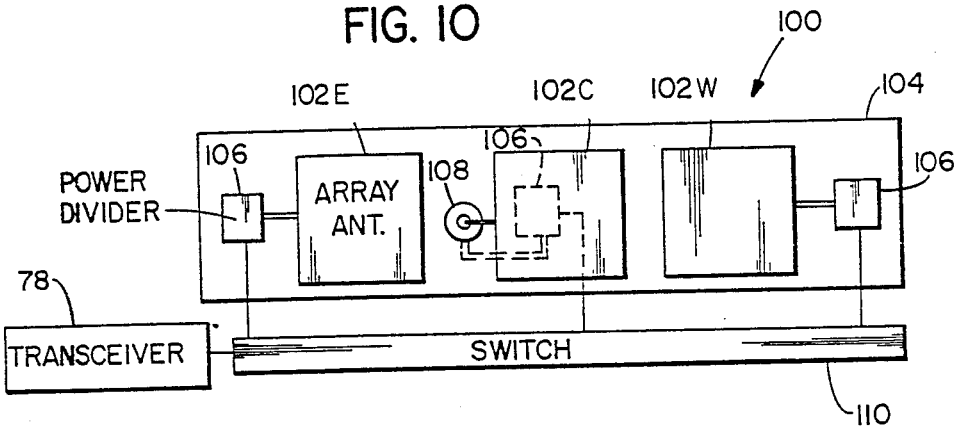
FIG. 10 shows three antenna system reflector feeds, such as that of FIG. 6, disposed on a common board for illumination of three separate portions of the earth's surface, each of the antenna systems producing a scannable fan beam for scanning a specific one of the portions of the earth's surface.

FIG. 10 shows a configuration of an antenna system 100 useful for the satellite communication situation of FIG. 7. In FIG. 10, the system 100 includes a set of three array antennas 102 arranged on a common support 104, which support may be constructed as the slab 26 of FIGS. 2 and 3 to serve as a common dielectric support for all three antennas 102. A set of three power dividers 106 is provided on the support 104, individual ones of the power dividers 106 being connected to respective ones of the antennas 102. Due to the close spacing of the antennas 102, there is room on the front side of the support 104 for only one power divider 106 at the left end of the support 104 and a second power divider 106 at the right end of the support 104. The power divider 106 connected to the center antenna 102 is disposed on the back side of the support 104, as indicated by phantom view. Connection of the central antenna 102 to its power divider is accomplished by means of a feedthrough connector 108 which allows passage of parallel electrical transmission lines through the support 104. The power dividers 106 are connected via a selector switch 110 to the transceiver 78. Each of the antennas 102 may be constructed as the antenna 66 with antenna elements 68 (FIG. 6), or 94 (FIG. 8), or 98 (FIG. 9). The power divider 106 may be constructed as the power divider 72 (FIG. 6), or the power divider 36 (FIG. 1).

The power divider 36, which operates by use of the set of phase shifters 30, may be employed as the power divider 106 in the steering of a beam in a direct radiating, array antenna, satellite communication situation; however, it is preferable to use the power divider 72 of FIG. 6 as the power divider 106 with a narrow bandwidth signal in which the radiation frequency differs for each position of the fan beam in the array fed, reflector antenna, satellite communication situation of FIG. 7. In each of the antennas 102, the radiators J, K, L, and M of the respective antenna elements are arranged in rows, with a set of all of the radiators J of all of the antenna elements of an antenna 102 being arranged in a column. Similarly, the sets of all of the radiators K, of all radiators L, and all radiators M of an antenna 102 are arranged in columns perpendicular to the rows.

With reference to the side-by-side arrangement of the antennas 102 in FIG. 10, and with reference to the reflector 86 of FIG. 7, it is appreciated that each antenna 102 has a different location relative to a focus of the reflector 86. This may be explained further by identifying the three antennas 102 individually by the legends 102E, 102C, and 102W as is shown both in FIG. 10 and in FIG. 7. Also, in FIG. 7, it is convenient to identify the beams 90 individually by the legends 90E, 90C, and 90W, respectively, for illumination of the eastern, central and western regions of the United States. Radiation of the beams 90E, 90C and 90W is provided respectively by the antennas 102E, 102C and 102W. The selector switch 110 provides for separate selective excitation of the antennas 102. Therefore, operation of the switch 110 for sequential excitation of the antennas 102 results in a shifting of the location of the source of illumination of the reflector 86 with a consequential shifting in the orientation of the beam produced by the antenna system 70 of FIG. 7.

Furthermore, the narrow band signal transmitted by the radiators 50 is narrower than the transmission bandwidth of any of the radiators. A variation in the carrier frequency of the narrow band signal results in a transmission from a radiator J or partially from a radiator J and a radiator K, or from a radiator K. Further shifts in carrier frequency produce radiation from radiators K and L, L, L and M, or M. In view of the columnar arrangement of the radiators J, as well as as the radiators K, L and M, the shift in frequency results in a shift in transmission of the signals from one column of radiators toward another column of radiators. This constitutes a shift in the location of a source of illumination of the reflector 86 with a consequent shifting in the orientation of the beam produced by the antenna system 70 of FIG. 7. By varying the frequency as a function of location on the earth, ground stations at each location can be tuned to the specific frequency assigned to that location. Thereby, in the situation wherein the satellite is traveling in a stationary orbit, ground stations can be selected both as a function of beam position and as a function of radiation frequency to minimize the chance that an unintended station may be the recipient of a message.

In operation, the system 100 of FIG. 10 provides for three separate general areas of beam pointing corresponding to the three regions 112, 114, and 116 of the United States, identified in FIG. 7. A scanning by use of the antenna 102E and power divider 106 located on the left end of the support 104 provides for the scanning of the fan beam 90E from east to west within the confines of the eastern region 116. Similarly, the antenna 102C and power divider 106 in the center of the support 104 provide for a scanning of the fan beam 90C from east to west within the confines of the central region 114. And the antenna 102W and power divider 106 at the right side of the support 104 provide for a scanning of the fan beam 90W from east to west within the confines of the western region 112. The switch 110 is operative to couple signals from the transceiver 78 to a selected one of the three power dividers 106. The use of the common support 104 for all of the antennas 102 and all of the power dividers 106 provides for a compact structure which facilitates installation aboard a satellite.

Thus, there are two modes of orienting the beam. A large shift from region to region (the regions 112–116 of FIG. 7) is accomplished by use of the switch 110 in FIG. 10. A scanning of the beam within any one of the regions 112–116 is accomplished by shifting the frequency of the transmitted signal by use of the selector 82 (Fig, 6).

With reference to FIG. 5, it is noted that the skirts of the trace representing one transmission band overlap the skirts of the next transmission band. Thus, at radiation at a border line frequency between the frequency responses of adjacent radiators, there can be equal radiation from two of the radiators, such as the radiators J and K in FIGS. 2 and 6. In such case, the two signals radiating from the adjacent radiators have equal phase. The effect upon the transmitted beam is to produce a slight widening of the beam at the intermediate frequencies when the radiation from a single radiator is replaced by radiation from two radiators feeding the reflector.

With respect to details in the construction of the microstrip antennas, each of the embodiments disclosed herein uses a construction having the same cross section as was disclosed for the antenna element 24 in FIG. 3. The pad of a radiator 50 has a thickness of preferably six skin depths which, for gold at a frequency of 1 GHz (gigahertz) is approximately 0.6 mil. Excessive thickness is avoided because of change in impedance presented by the radiator 50 to the circulator 52. The thickness of the ground plane 58 is also approximately 6 skin depths of the transmitted radiation. With respect to avoidance of the surface waves, if the slab 26 has a dielectric constant of approximately 2.3, as is the case with a dielectric fabricated as a blend of glass fibers with a fluorinated hydrocarbon such as Teflon, then the thickness of the slab should be less than 0.09 wavelengths in free space. By way of further example, if the dielectric be a ceramic such as alumina having a dielectric constant of 10, then the thickness of the slab should be less than 0.03 wavelengths in free space to avoid surface waves. As a further example, the dielectric material of the slab may be a fused silica having a dielectric constant of 3.825, and wherein at a radiation frequency of 14.4 GHz and a free-space wavelength of 0.82 inch, the slab maximum thickness to avoid surface waves is 60 mils. A square-shaped radiator, such as the radiator 62 of Fig. 4 should have dimensions of the sides which are approximately one-half wavelength in the dielectric. In the foregoing example of radiation at 14.4 GHz, each side of the radiator 62 measures 0.170 inch.

As an example in the construction of the antenna system 70 of FIG. 7, at a radiation frequency of 1.55 GHz, the reflector 86 extends across 360 inches in the vertical direction, 480 inches in the horizontal direction, and has a focal length of 280 inches. The array antenna 66 is offset from the focus by 100 inches and may be formed of 96 microstrip patch antennas separated 5.468 inches apart. Each of the four spectral zones in Fig. 5 has a width of 2.25 MHz.

With respect to the construction of the ferrite circulators 52 of FIG. 2, at 10 GHz, the outer diameter of the circulator 52 is 0.2 inch. At 5 GHz, the diameter is 0.370 inch, and at 1.55 GHz, the diameter is 0.68 inch, these diameters being less than two-tenths of the radiation wavelength.

The microstrip antenna system of the invention provides for a compact structure which is readily deployed upon a vehicle, can be manufactured to precision tolerances for accurate control of electrical characteristics, and is operated readily for forming and steering a beam of radiation. By use of plural power dividers, the invention is readily employed with a reflector for selectively scanning predetermined areas of the earth's surface so as to facilitate electrical communication via satellite.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. An antenna system comprising:

an array of microstrip antenna elements, each of said elements comprising a first radiator, a second radiator, and a circulator;

power dividing means connected to an input terminal of each of said antenna elements; and wherein in each of said elements, said circulator has a plurality of ports, a first of said ports connecting at said input terminal with said power dividing means, a second of said ports connecting with said first radiator, and a third of said ports connecting with said second radiator;

in each of said elements, said second radiator is operative to radiate in a second frequency band higher than a first radiation frequency band of said first radiator, said first radiator reflecting radiation of said second frequency band via said circulator to said second radiator;

said power dividing means transmits radiation occupying the frequency bands of both radiators via said circulator in each of said antenna elements towards the input terminal in each of said elements; and corresponding ones of the radiators of said antenna elements are spaced apart with predetermined spacings for generation of a beam of radiation by the antenna system.

2. A system according to claim 1 wherein said power dividing means comprises phase shift means connecting with the input terminal in each of said antenna elements, said power dividing means transmitting a broadband signal occupying concurrently the frequency bands of both radiators, said phase shift means being operative to form a beam radiating from said array in a predetermined direction.

3. A system according to claim 2 wherein each of said elements includes a third radiator and a second circulator, said second circulator interconnecting said first-mentioned circulator with said second radiator, said second circulator having a plurality of ports, a first of the ports of said second circulator connecting to said third port of said first circulator, said second port of said second circulator connecting with said second radiator, and a third port of said second circulator connecting with said third radiator; and said third radiator is operative to radiate in a third frequency band higher than said second frequency band, said second radiator reflecting radiation of said third band via said second circulator to said third radiator, said power dividing means transmitting radiation occupying concurrently said first and said second and said third frequency bands.

4. A system according to claim 1 further comprising a reflector facing said array of antenna elements to be illuminated by said array of antenna elements for forming said beam of radiation; and wherein said power dividing means transmits a succession of narrow band radiation signals, a first of said narrow band signals appearing in said first frequency band followed by a second of said narrow band signals in said second frequency band; and the radiation signal frequency in each of said bands acts to shift a site of illumination of said reflector from one antenna element to another antenna element to redirect said beam of radiation, directions of said beam differing with the frequency of said narrow band signal to provide a swept beam upon a shifting of frequency of said narrow band signal.

5. A system according to claim 4 wherein each of said elements includes a third radiator and a second circulator, said second circulator interconnecting said first-mentioned circulator with said second radiator, said second circulator having a plurality of ports, a first of the ports of said second circulator connecting to said third port of said first circulator, said second port of said second circulator connecting with said second radiator, and a third port of said second circulator connecting with said third radiator; and said third radiator is operative to radiate in a third frequency band higher than said second frequency band, said second radiator reflecting radiation of said third band via said second circulator to said third radiator, said power divider means transmitting radiation occupying sequentially said first and said second and said third frequency bands.

6. A system according to claim 4 wherein said power dividing means comprises a plurality of power dividers and said array of antenna elements comprises a plurality of subarrays of antenna elements, a first of said power dividers being connected to a first of said subarrays, and a second of said power dividers being connected to a second of said subarrays, said second subarray being displaced from said first subarray about a focus of said reflector for redirecting said beam upon a shift in illumination of said reflector from said first subarray to said second subarray.

7. A system according to claim 6 wherein said beamformer means includes means for selectively activating individual ones of said power dividers for steering said beam.

8. A system according to claim 1 wherein each of said elements includes a third radiator and a second circulator, said second circulator interconnecting said first-mentioned circulator with said second radiator, said second circulator having a plurality of ports, a first of the ports of said second circulator connecting to said third port of said first circulator, said second port of said second circulator connecting with said second radiator, and a third port of said second circulator connecting with said third radiator; and said third radiator is operative to radiate in a third frequency band higher than said second frequency band, said second radiator reflecting radiation of said third band via said second circulator to said third radiator, said power divider means transmitting radiation occupying concurrently said first and said second and said third frequency bands; and wherein in each of said antenna elements, said circulators are ferrite circulators; and each of said antenna elements comprises a ground plane, a dielectric slab disposed on said ground plane, each of said radiators resting on said slab on a side thereof opposite said ground plane, said radiators being formed as metallic pads connected by metallic strip conductors to said circulators, the dimensions of the pads of respective radiators differing to provide differing values of radiation frequency bands of said respective radiators.

9. A system according to claim 8 wherein said radiators have a rectangular shape.

10. A system according to claim 8 wherein said radiators have a square shape.

11. A system according to claim 10 wherein each of said radiators is provided with a slot oriented diagonally with respect to a side of the radiator, the slot providing a characteristic of circular polarization to electromagnetic waves radiated by the radiator.

* * * * *